US006476698B1

(12) United States Patent
Anand et al.

(10) Patent No.: US 6,476,698 B1
(45) Date of Patent: Nov. 5, 2002

(54) CONVERTIBLE LOCKING ARRANGEMENT ON BREAKERS

(75) Inventors: R. Prem Anand, Chennai (IN); Tumkur K. Shachidevi, Bangalore (IN); Ganesh C. Shankar, Tiruttani (IN); Patrick Letient, Saint-Quentin (FR); K. V. Sridhar, Bangalore (IN); Janakiraman Narayanan, Hosure (IN); Mahesh J. Rane, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/686,660

(22) Filed: Oct. 11, 2000

Related U.S. Application Data

(60) Provisional application No. 60/190,181, filed on Mar. 17, 2000.

(51) Int. Cl.[7] ..... H01H 13/04

(52) U.S. Cl. ..... 335/202; 335/6; 200/43.01

(58) Field of Search ..... 200/43.01, 43.02, 200/50.11, 318, 333; 174/53, 66–67; 335/202

(56) References Cited

U.S. PATENT DOCUMENTS

| | | | | |
|---|---|---|---|---|
| 2,340,682 A | | 2/1944 | Powell | |
| 2,719,203 A | | 9/1955 | Gelzheiser et al. | |
| 2,813,938 A | * | 11/1957 | Speizman | 200/43.11 |
| 2,937,248 A | | 5/1960 | Michetti | |
| 2,937,254 A | | 5/1960 | Ericson | |
| 3,109,899 A | * | 11/1963 | Pastene | 200/43.14 |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,517,356 A | | 6/1970 | Hanafusa | |
| 3,631,369 A | | 12/1971 | Menocal | |
| 3,803,455 A | | 4/1974 | Willard | |
| 3,883,781 A | | 5/1975 | Cotton | |
| 4,129,762 A | | 12/1978 | Bruchert | |
| 4,144,513 A | | 3/1979 | Shafer et al. | |
| 4,158,119 A | | 6/1979 | Krakik | |
| 4,165,453 A | | 8/1979 | Hennemann | |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |

(List continued on next page.)

*Primary Examiner*—Lincoln Donovan
*Assistant Examiner*—Tuyen T. Nguyen
(74) *Attorney, Agent, or Firm*—Cantor Colburn LLP

(57) ABSTRACT

In an exemplary embodiment of the invention, a locking mechanism comprising a blocking member sized to fit within the elongated slot through which a circuit breaker handle extends is disclosed. The blocking member may be seated adjacent the circuit breaker handle within the elongated slot and may snap or otherwise be locked into place to prevent the circuit breaker handle from moving within the slot. Thus, if the blocking member is placed within the elongated slot when the circuit breaker handle is in an OFF position, then the circuit breaker handle will be locked in the OFF position. The blocking member can be converted for locking the circuit breaker handle in an ON position. Then, when the blocking member is placed within the elongated slot when the circuit breaker handle is in an ON position, then the circuit breaker handle will be locked in the ON position. Once the blocking member is made for use in locking the circuit breaker in an ON condition, it cannot be converted back for use as a blocking member for locking the circuit breaker handle in an OFF position.

33 Claims, 5 Drawing Sheets

Configuration for Locking in OFF Position

U.S. PATENT DOCUMENTS

| | | | | |
|---|---|---|---|---|
| 4,166,988 | A | | 9/1979 | Ciarcia et al. |
| 4,220,934 | A | | 9/1980 | Wafer et al. |
| 4,255,732 | A | | 3/1981 | Wafer et al. |
| 4,259,651 | A | | 3/1981 | Yamat |
| 4,263,492 | A | | 4/1981 | Maier et al. |
| 4,276,527 | A | | 6/1981 | Gerbert-Gaillard et al. |
| 4,297,663 | A | | 10/1981 | Seymour et al. |
| 4,300,030 | A | * | 11/1981 | Dimarco et al. ..... 200/322 |
| 4,301,342 | A | | 11/1981 | Castonguay et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |
| 4,435,690 | A | | 3/1984 | Link et al. |
| 4,467,297 | A | | 8/1984 | Boichot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,717,985 | A | | 1/1988 | Demeyer |
| 4,733,211 | A | | 3/1988 | Castonguay et al. |
| 4,733,321 | A | | 3/1988 | Lindeperg |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McGhie |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,963,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nebon et al. |
| 5,030,804 | A | | 7/1991 | Abri |
| 5,057,655 | A | | 10/1991 | Kersusan et al. |
| 5,060,107 | A | * | 10/1991 | Castonguay ..... 361/115 |
| 5,077,627 | A | | 12/1991 | Fraise |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,296,660 | A | | 3/1994 | Morel et al. |
| 5,296,664 | A | | 3/1994 | Crookston et al. |
| 5,298,874 | A | | 3/1994 | Morel et al. |
| 5,300,907 | A | | 4/1994 | Nereau et al. |
| 5,310,971 | A | | 5/1994 | Vial et al. |
| 5,313,180 | A | | 5/1994 | Vial et al. |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,348,405 | A | * | 9/1994 | Lupkas ..... 400/490 |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |

| | | | |
|---|---|---|---|
| 5,504,290 | A | 4/1996 | Baginski et al. |
| 5,504,294 | A | 4/1996 | Lazareth et al. |
| 5,510,761 | A | 4/1996 | Boder et al. |
| 5,512,720 | A | 4/1996 | Coudert et al. |
| 5,515,018 | A | 5/1996 | DiMarco et al. |
| 5,519,561 | A | 5/1996 | Mrenna et al. |
| 5,534,674 | A | 7/1996 | Steffens |
| 5,534,832 | A | 7/1996 | Duchemin et al. |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |

FOREIGN PATENT DOCUMENTS

| | | | | |
|---|---|---|---|---|
| DE | 38 43 277 | | 6/1990 | |
| DE | 44 19 240 | | 1/1995 | |
| EP | 0 061 092 | | 9/1982 | |
| EP | 0 064 906 | | 11/1982 | |
| EP | 0 066 486 | | 12/1982 | |
| EP | 0 076 719 | | 4/1983 | |
| EP | 0 117 094 | | 8/1984 | |
| EP | 0 140 761 | | 5/1985 | |
| EP | 0 174 904 | | 3/1986 | |
| EP | 0 196 241 | | 10/1986 | |
| EP | 204479 | A | 12/1986 | ..... H01H/9/28 |
| EP | 0 224 396 | | 6/1987 | |
| EP | 0 235 479 | | 9/1987 | |
| EP | 0 239 460 | | 9/1987 | |
| EP | 0 258 090 | | 3/1988 | |
| EP | 0 264 313 | | 4/1988 | |
| EP | 0 264 314 | | 4/1988 | |
| EP | 0 283 189 | | 9/1988 | |
| EP | 0 283 358 | | 9/1988 | |
| EP | 0 291 374 | | 11/1988 | |
| EP | 0 295 155 | | 12/1988 | |
| EP | 0 295 158 | | 12/1988 | |
| EP | 0 309 923 | | 4/1989 | |
| EP | 0 313 106 | | 4/1989 | |
| EP | 0 313 422 | | 4/1989 | |
| EP | 0 314 540 | | 5/1989 | |
| EP | 0 331 586 | | 9/1989 | |
| EP | 0 337 900 | | 10/1989 | |
| EP | 0 342 133 | | 11/1989 | |
| EP | 0 367 690 | | 5/1990 | |
| EP | 0 371 887 | | 6/1990 | |
| EP | 0 375 568 | | 6/1990 | |
| EP | 0 394 144 | | 10/1990 | |
| EP | 0 394 922 | | 10/1990 | |
| EP | 0 392 282 | | 11/1990 | |
| EP | 0 399 282 | | 11/1990 | |
| EP | 0 407 310 | | 1/1991 | |
| EP | 0 452 230 | | 10/1991 | |
| EP | 0 555 158 | | 8/1993 | |
| EP | 0 560 697 | | 9/1993 | |
| EP | 0 567 416 | | 10/1993 | |
| EP | 0 595 730 | | 5/1994 | |
| EP | 604331 | A | 6/1994 | ..... H01H/9/28 |
| EP | 0 619 591 | | 10/1994 | |
| EP | 0 665 569 | | 8/1995 | |
| EP | 0 700 140 | | 3/1996 | |
| EP | 0 889 498 | | 1/1999 | |
| FR | 2 410 353 | | 6/1979 | |
| FR | 2 512 582 | | 3/1983 | |
| FR | 2 553 943 | | 4/1985 | |
| FR | 2 592 998 | | 7/1987 | |
| FR | 2 682 531 | | 4/1993 | |
| FR | 2 697 670 | | 5/1994 | |
| FR | 2 699 324 | | 6/1994 | |
| FR | 2 714 771 | | 7/1995 | |
| GB | 2 233 155 | | 1/1991 | |
| GB | 2285887 | | 7/1995 | ..... H01H/9/28 |
| WO | 92/00598 | | 1/1992 | |
| WO | 92/05649 | | 4/1992 | |
| WO | 94/00901 | | 1/1994 | |

* cited by examiner

Configuration for Locking in OFF Position

Configuration for Locking in ON Position

Position for Locating Padlocks

CONVERTIBLE LOCKING ARRANGEMENT ON BREAKERS

CROSS-REFERENCE TO RELATED APPLICATIONS

This application claims the benefit of the Provisional Application Ser. No. 60/190,181 filed Mar. 17, 2000, which is hereby incorporated by reference.

BACKGROUND OF THE INVENTION

The present invention relates to a circuit breaker handle arrangement, and more particularly relates to a locking mechanism for locking the circuit breaker handle in either an on position or an off position.

Circuit breaker handles today can typically be easily moved from an on position to an off position and from an off position to an on position, either manually or under trip conditions. Such manual ease of use is suitable for professional electricians and for end users in control of the connected environment. However, where control of the on-off status of a circuit breaker should not be given to unauthorized users or where the circuit breaker should remain on or off under certain circumstances, the ability to lock the circuit breaker handle into place would be desirable.

SUMMARY OF THE INVENTION

In an exemplary embodiment of the invention, a locking device comprises a first part having a first squeezable side and a second squeezable side, the first and second squeezable sides each having a top end and a bottom end, the first part further having a first connecting side and a second connecting side, the first and second connecting sides connecting the top end of the first squeezable side to the top end of the second squeezable side. A first slot-engaging tab preferably extends outwardly from the bottom end of the first squeezable side and a second slot-engaging tab preferably extends outwardly from the bottom end of the second squeezable side. The first part is sized to fit within a handle slot of a circuit breaker housing with the first and second slot-engaging tabs retaining the first part within the handle slot. The first part may be removed from the handle slot by compressing the first and second squeezable sides inwardly to release the first and second slot engaging tabs from the handle slot. The locking device may further comprise a second part sized to fit within the first part, wherein the second part engaged with the first part prevents the first and second squeezable sides of the first part from being compressed inwardly, thus preventing the removal of the locking device.

DETAILED DESCRIPTION OF THE PREFERRED EMBODIMENTS

Figure 1:
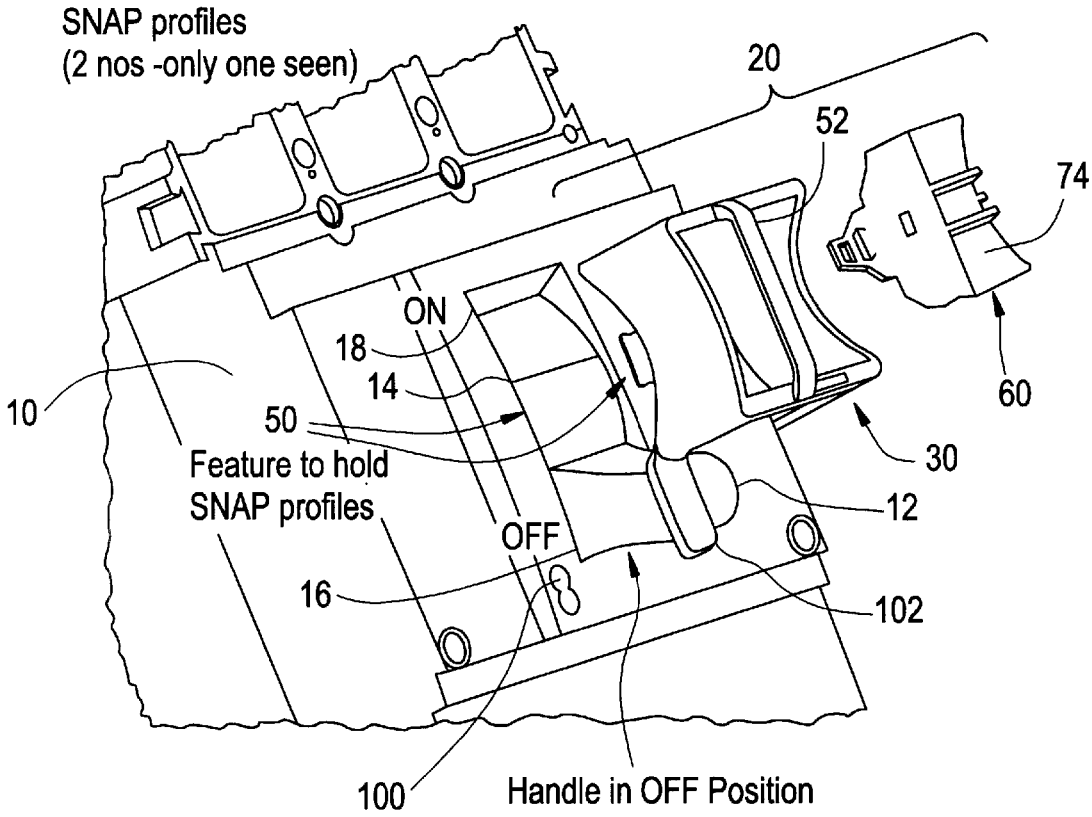
FIG. 1 shows a top exploded perspective view of a circuit breaker with a handle in an OFF position and a locking mechanism of the present invention.

As shown in FIG. 1, a circuit breaker 10 is provided with a circuit breaker handle 12 moved to an OFF position. Within the circuit breaker 10, the handle 12 is connected to mechanisms (not shown) which enable the handle 12 to move from the OFF position to an ON position, or an ON position to an OFF position, either manually or through a tripping action. The handle 12 protrudes from an elongated slot 14 within the circuit breaker 10. The slot 14 has an OFF-side 16 and an ON-side 18 which correspond to OFF and ON positions of the handle 12. Without the locking mechanism of the present invention, the circuit breaker handle 12 could be moved manually from the OFF position shown to an ON position by sliding the handle 12 from the OFF-side 16 to the ON-side 18 of the elongated slot 14. Under certain circumstances, however, it may be desirable to maintain the circuit breaker 10 in an OFF condition, which would require the circuit breaker handle 12 to remain in the OFF position adjacent the OFF-side 16 of elongated slot 14.

The present invention provides a locking mechanism or device 20 which can insure that the circuit breaker handle 12 will not be moved inadvertently or purposely from an OFF position to an ON position.

The locking mechanism 20 of the present invention is in the form of a blocking member which blocks the handle 12 from moving in one direction or the other, depending on which position the handle 12 is to be locked. The blocking member preferably includes a first part 30 and a second part 60. The first part 30, as shown in detail in FIGS. 7–9, preferably includes a first squeezable side 32 having a top end 34 and a bottom end 36 and a second squeezable side 38 having a top end 40 and a bottom end 42. The first part 30 further preferably has a first connecting side 44 and a second connecting side 46 sized to fit within the width of the elongated slot 14. The first and second connecting sides 44 and 46 connect the top end 34 of the first squeezable side 32 to the top end 40 of the second squeezable side 38. Also, each squeezable side 32, 38 preferably includes a snap fit profile or tab 48 at the bottom ends 36, 42. The tabs 48 are preferably dimensioned to catch with the interior of the molded frame of the circuit breaker at the elongated slot 14. That is, the first part 30 may be pushed within the elongated slot 14 until the first part 30 snaps into place. The elongated slot 14 may include indents 50 to correctly align and capture the tabs 48 therein. The first part 30 may be removed from the elongated slot 14 by compressing the squeezable sides 32, 38 towards each other, i.e. inwardly, thus releasing the snap fit profiles or tabs 48 from the interior of the elongated slot 14 or from indents 50, and pulling the first part 30 out from the elongated slot 14. Thus, when used alone, the first part 30 of the locking mechanism 20 will effectively prevent someone from accidentally moving the circuit breaker handle 12 from an OFF position to an ON position. Also, when used alone, the first part 30 can provide a reversible locking mechanism for use in either the OFF or ON position.

Figure 7:
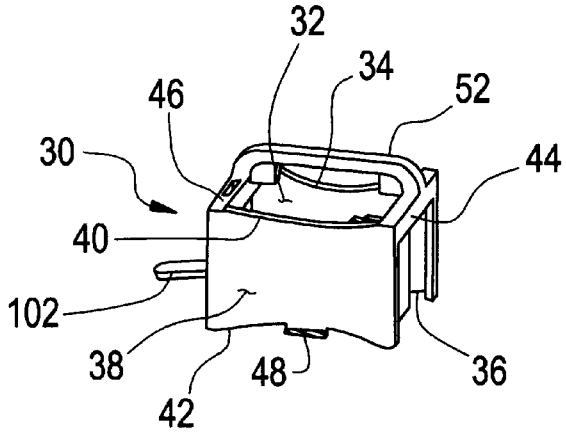
FIG. 7 shows a side perspective view of the first part of the locking mechanism.
Figure 8:
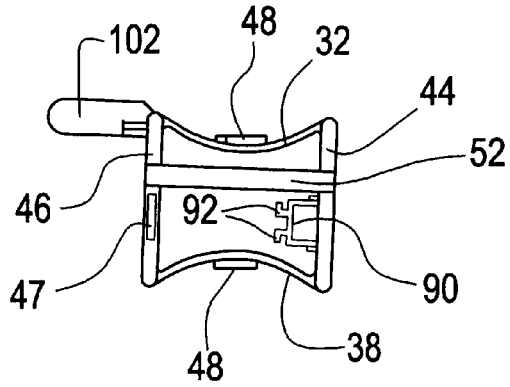
FIG. 8 shows a top plan view of the first part of the locking mechanism.
Figure 9:
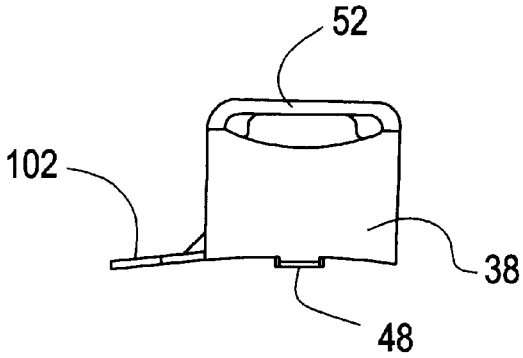
FIG. 9 shows a side plan view of the first part of the locking mechanism.
Figure 10:
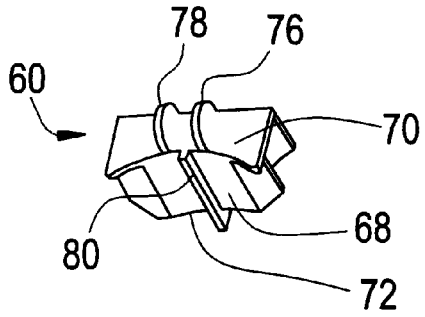
FIG. 10 shows a right-side perspective view of the second part of the locking mechanism.
Figure 11:
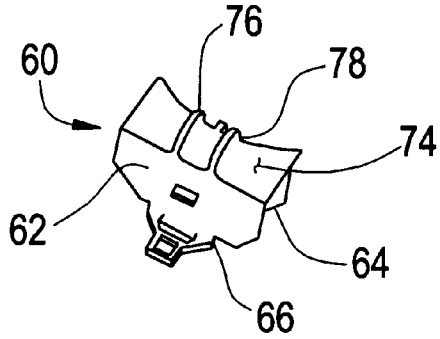
FIG. 11 shows a left-side perspective view of the second part of the locking mechanism.
Figure 12:
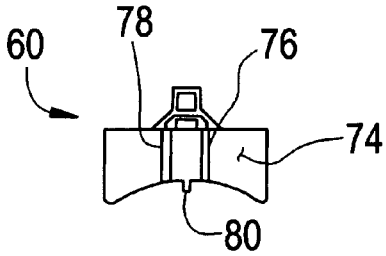
FIG. 12 shows a top plan view of the second part of the locking mechanism.
Figure 13:
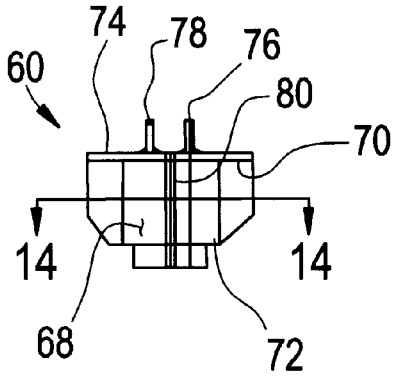
FIG. 13 shows a right-side plan view of the second part of the locking mechanism; and, FIG. 14 shows a cross-sectional view taken along line 14–14 of FIG. 13.
Figure 14:
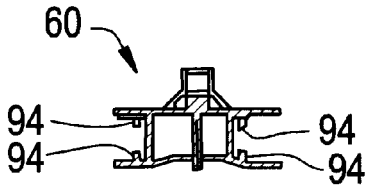

As further shown in FIGS. 7–9, the first part 30 can include a locking mechanism handle portion 52 which connects the first and second connecting sides 44, 46 of the first part 30 to enable the first part 30 to be easily lifted out of the elongated slot 14 during removal.

The locking mechanism 20 of the present invention may further comprise a second part 60, as detailed in FIGS. 10–14, which cooperates with the first part 30 to render the locking effect of the locking mechanism 20 substantially irreversible. As shown in FIG. 1, the second part 60 preferably fits within the squeezable sides 32, 38 of the first part 30. When in place, the second part 60 prevents the squeezable sides 32, 38 of the first part 30 from being squeezed together, thus disabling the removal of the first part 30 from the elongated slot 14. The second part 60 preferably includes a first surface 62 having a top end 64 and a bottom end 66 and a second surface 68 having a top end 70 and a bottom end 72. The second part 60 further preferably includes a top surface 74 connecting the top end 70 of the second surface 68 to the top end 64 of the first surface 62. The top surface 74 preferably includes a pair, or more, of protrusions 76, 78 for spacing apart padlocks as will be discussed. When positioned within the first part 30, the second part 60 is preferably seated on one side of the handle 52 as shown. As shown, the second surface 68 of the second part 60 is curved to compliment the curved surface of the second squeezable side 38. The second surface 68 is preferably in direct abutment with the second squeezable side 38 and further preferably includes a longitudinal rib 80, which may extend from the top end 70 to the bottom end 72 of the second surface 68, for further compression against the second squeezable side 38, thus further preventing the second squeezable side 38 from being squeezed, and thus retaining the locking mechanism 20 within the elongated handle slot 14.

To retain the second part 60 within the first part 30, the first part 30 preferably includes an insert portion 90 shown in FIG. 8 which extends from the first connecting side 44 and into the interior of the first part 30. The insert portion 90 is preferably integrally attached to the first connecting side 44. The insert portion 90 preferably includes a pair of flanges 92 which cooperate with flanges 94 within the second part 60 to retain the second part 60 within the first part 30. Alternatively, the mating flanges 92 and 94 could be replaced with dovetail grooves and recesses, mating ribs and grooves, or other suitable means for retention.

With the insert portion 90 adjacent the ON-side 18 of the elongated slot 14, the first part 30, having the insert portion 90 on the first connecting side 44, blocks the area of the first connecting side 44 such that the circuit breaker handle 12 can only extend underneath the second connecting side 46 of the first part 30. In this initial position of the insert portion 90, the locking mechanism 20 can only be used to lock the handle 12 in the OFF position.

Figure 5:
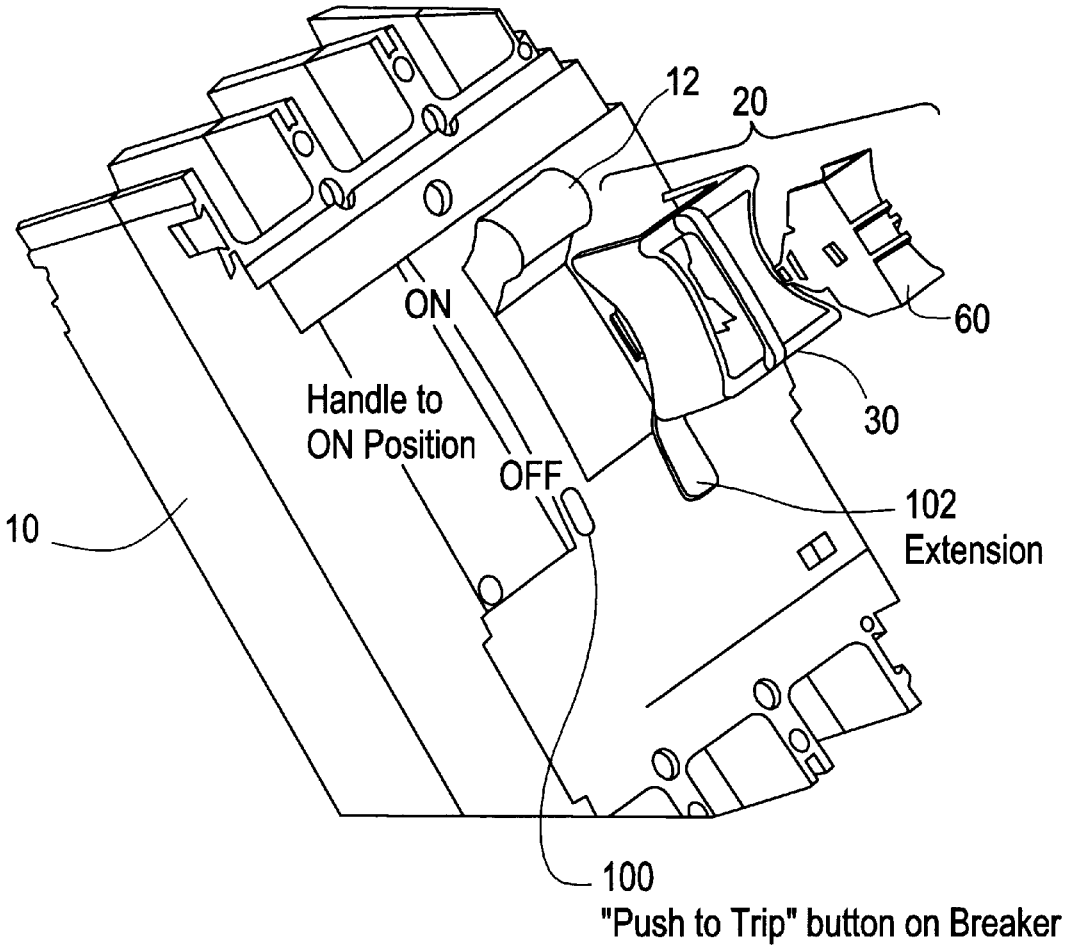
FIG. 5 shows a top exploded perspective view of a circuit breaker with a handle in an ON position and a locking mechanism of the present invention.

As shown in FIG. 5, a circuit breaker 10 is provided with a circuit breaker handle 12 moved to an ON position. Without the locking mechanism 20 of the present invention, the circuit breaker handle 12 could be moved manually from the ON position shown to an OFF position by sliding the handle 12 towards the OFF-side 16 of the elongated slot 14 (to the position shown in FIG. 1). Under certain circumstances, however, it may be desirable to maintain the circuit breaker 10 in an ON condition, which would require the circuit breaker handle 12 to remain in the ON position as shown in FIG. 5.

The locking mechanism 20 of the present invention is also designed to insure that the circuit breaker handle 12 will not be moved inadvertently or purposely from an ON position to an OFF position.

Figure 2:
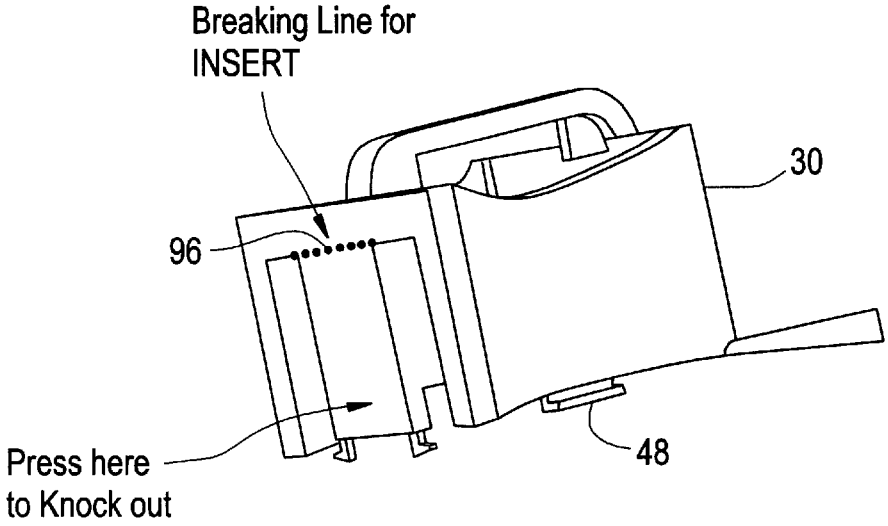
FIG. 2 shows a partial perspective view of a first part of a locking mechanism of the present invention.
Figure 3:
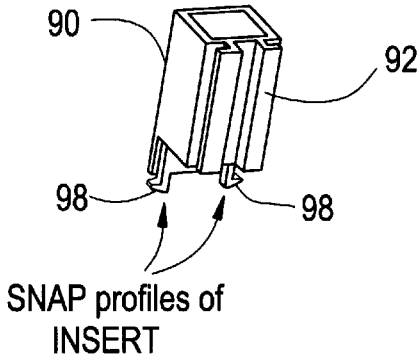
FIG. 3 shows a perspective view of an insert member removed from the first part of the locking mechanism.
Figure 4:
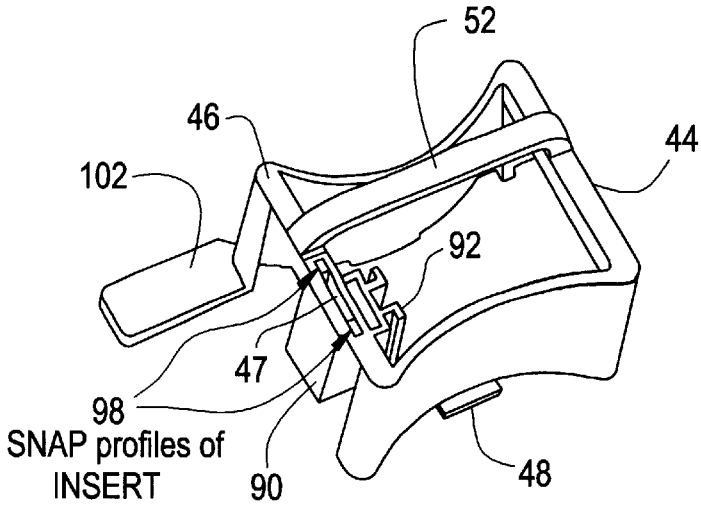
FIG. 4 shows a perspective view of the insert member placed on an opposite side of the first part of the locking mechanism.

When the first part 30 is used to lock the circuit breaker handle 12 in the ON position, the insert portion 90 may be removed from the first connecting side 44 of the first part 30. Removal of the insert portion 90 may be accomplished by providing lines of weakness 96 within the material of the first part 30 as shown in FIG. 2 and knocking-out the insert portion 90 along the lines of weakness 96. Once removed, the insert portion 90 may appear as shown in FIG. 3, and then be moved to the second connecting side 46 and secured thereto as shown in FIG. 4. The insert portion 90 may include snap profiles or tabs 98 which can be pushed within a slot 47 in the second connecting side 46 to retain the insert portion 90 in its new position along second connecting side 46. With the insert portion 90 in the position shown in FIG. 4, the first part 30 is configured to allow a circuit breaker handle 12 to pass underneath the first connecting side 44, and may thus be used to lock the circuit breaker handle 12 in the ON position. The second part 60 preferably includes a second pair of mating flanges 94, or other engagement device, to accommodate engagement with the insert portion 90 in this new position.

As shown, removing the insert portion 90 from the first part 30 is a one-time field modification. That is, if a customer desires to use the locking mechanism 20 for ON locking, then the insert portion 90 must be broken away. In doing so, it is indicated that a field modification has been done. This is done only in rare applications, when the circuit breaker should be in ON always, such as to avoid the unwanted stopping of power supply to a machine which has to undergo some continuous operation. This one time field modification of the locking mechanism 20 from an OFF locking device to an ON locking device provides benefits to both the customer and to the manufacturer. From a customer's perspective, the installer of the locking mechanism cannot lock a breaker in an ON or OFF condition without knowing exactly what is intended for the circuit breaker in a particular application. The circuit breaker will be locked in an OFF condition unless the insert portion is broken off, in which case the circuit breaker can only be locked in an ON condition. In addition, because it is much more likely that the circuit breaker will be locked in an OFF condition, someone would have to purposely redesign the locking mechanism for converting it to a locking device for locking a circuit breaker in an ON condition. From a manufacturer's perspective, once the customer decides to convert the locking mechanism to an ON-use and then uses it to lock the circuit breaker in an ON condition, if an accident occurs during the breaker locked in an ON condition, then the customer cannot claim that he has only locked in an OFF condition but the accident has occurred due to breaker malfunctioning. The broken piece of the one-time converted locking system will tell that it has been used for ON condition locking only.

A circuit breaker 10 may include a "push to trip" button 100 adjacent the elongated slot 14. When the circuit breaker handle 12 is to be locked into the ON position with the locking mechanism 20 of the present invention, there is preferably a means to prevent this "push to trip" button 100 from being pressed, since pushing such a button 100 would defeat the purpose of having the circuit breaker handle 12 locked into an ON position. To accomplish this prevention, an extension 102, such as a generally planar, elongated flange extending substantially parallel to a top surface of the circuit breaker molded frame and from the bottom end 36 of the first squeezable side 32 adjacent the second connecting side 46 of the first part 30. This flange 102, or extension, is adapted to overlie the trip push button 100 thus preventing someone from tripping the circuit breaker to an OFF condition when the first part 30 of the locking mechanism 20 is in place within the elongated handle slot 14. Thus, with the locking mechanism 20 in place, the flange 102 shown in FIG. 5 covers the "push to trip" button 100 for preventing the circuit breaker 10 from reverting to an OFF condition.

As described above with respect to the locking mechanism 20 used with the circuit breaker handle 12 in the OFF position, the locking mechanism 20 may be placed within the elongated slot 14 of the circuit breaker 10 as shown in FIG. 5 to secure the circuit breaker handle 12 in the ON position. To do so, the first part 30 of the locking mechanism 20 is pushed within the elongated slot 14. The snap profile 48 at the base again secures the first part 30 within the elongated slot 14. The first part 30 may be removed by squeezing the opposing sides 32, 38 together to release the snap profile 48 from the slot 14. To prevent the first part 30 from being removed, a second part 60 may be inserted between the opposing sides 32, 38 thus preventing the opposing sides 32, 38 from being squeezed together.

Figure 6:
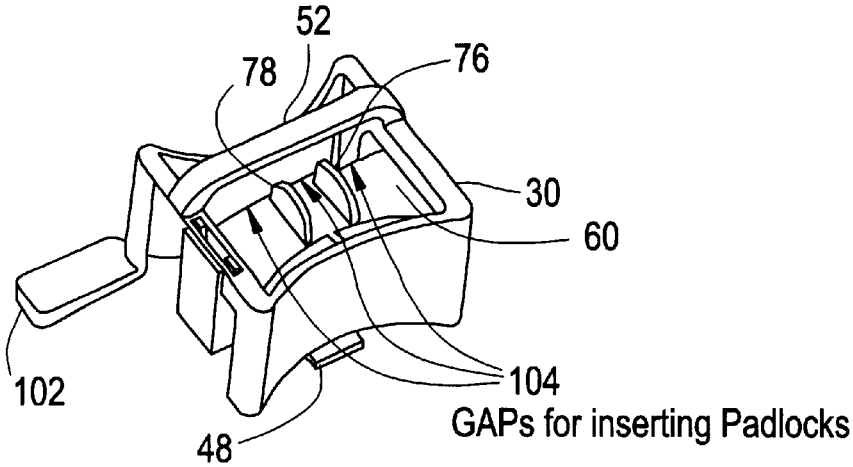
FIG. 6 shows a top perspective view of the second part of the locking mechanism of the present invention inserted within the first part.

The second part 60 may be padlocked to the first part 30 through gaps 104 shown in FIG. 6 to prevent removal of the locking mechanism 20 from the elongated slot 14, thereby ensuring that the circuit breaker handle 12 is locked into the ON position shown in FIG. 5. The gaps 104 are created by projections 78, 76 in the second part top surface 74 and the handle 52 of the first part 30, to prevent the second part 60 from being removed from the first part 30, and thereby insuring that the circuit breaker handle 12 is locked into place until the padlocks (not shown), second part 60 and first part 30 are all removed. The gaps 104 can be suitably spaced for helping to keep the padlocks separated from one another. It is also within the scope of this invention to enable an authorized user to remove the padlocks and remove the second part 60 from the first part 30 to be able to remove the first part 30 from the elongated slot 14 to thus be able to once again move the circuit breaker handle 12 from one side to another of the elongated slot 14.

Although snap fit securements have been described with respect to the first part 30, second part 60, and insert portion 90, it would be within the scope of this invention to provide other fastening means to secure the elements of the locking mechanism 20 to each other or to the circuit breaker elongated slot 14. Also, although a detailed embodiment is shown in the attached drawings, it would be within the scope of this invention to design a similar locking mechanism for different circuit breakers. The locking mechanism 20 of the present invention is preferably molded in plastic, but other suitable materials are within the scope of this invention.

The locking arrangement described herein is convertible so that it may be used for locking the circuit breaker handle 12 in either the "OFF" position or in the "ON" position. The conversion of the locking arrangement is simple, and able to be completed by field personnel. Once the locking mechanism is converted for locking a circuit breaker in an "ON" position, it cannot be converted back to a locking mechanism for locking the circuit breaker in an "OFF" position. In either condition, the locking mechanism may be padlocked for irremovability by unauthorized personnel.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the overall inventive concepts described herein.

What is claimed is:

1. A locking device for a circuit breaker handle, the locking device comprising:

a first part having a first squeezable side and a second squeezable side, the first and second squeezable sides each having a top end and a bottom end;

the first part further having a first connecting side and a second connecting side, the first and second connecting sides connecting the top end of the first squeezable side to the top end of the second squeezable side;

a first slot-engaging tab extending outwardly from the bottom end of the first squeezable side and a second slot-engaging tab extending outwardly from the bottom end of the second squeezable side; and, a second part sized to fit within the first part;

wherein the first part is for fitting within a slot in a circuit breaker housing with the first and second slot-engaging tabs for retaining the first part within the slot, wherein the first part is removable from the slot by compressing the first and second squeezable sides inwardly to release the first and second slot engaging tabs from the slot, and further wherein the second part fitted within the first part prevents the first and second squeezable sides of the first part from being compressed inwardly.

2. The locking device of claim 1 wherein the first part further comprises an extension protruding from the bottom end of the first squeezable side and adjacent the second connecting side, the extension for overlying a push-to-trip button on a circuit breaker housing.

3. The locking device of claim 2 wherein the extension is an elongated flange.

4. The locking device of claim 1 wherein the first part further comprises an insert portion attached to the first connecting side, and further wherein, with the insert portion attached to the first connecting side, the locking device is usable for locking a circuit breaker handle in an OFF position.

5. The locking device of claim 4 wherein the insert portion is integrally connected to the first connecting side by a breaking line for removing the insert portion from the first connecting side along the breaking line.

6. The locking device of claim 5 wherein the insert portion is removable from the first connecting side along the breaking line and subsequently attachable to the second connecting side.

7. The locking device of claim 6 wherein the second connecting side is provided with a slot for receiving a snap profile extending from the insert portion.

8. The locking device of claim 1 further comprising a handle portion connecting a mid-portion of the first connecting side to a mid-portion of the second connecting side.

9. The locking device of claim 1 wherein the second part comprises a first surface, a second surface, the first surface and the second surface each having a top end and a bottom end, the second part further comprising a top surface connecting the end of the first surface to the top end of the second surface.

10. The locking device of claim 9 wherein the second surface of the second part is provided with a rib extending from the top end of the second surface to the bottom end of the second surface, the rib engaging with an interior of the second squeezable side.

11. The locking device of claim 10 wherein the second squeezable side of the first part and the second surface of the second part are complimentarily curved.

12. The locking device of claim 9 further comprising projections extending upwardly from the top surface of the second part, the projections for spacing apart padlocks for locking the first part to the second part.

13. The locking device of claim 1 further comprising an insert portion on the first part, the insert portion comprising flanges engaging with interior ribs within the second part for retaining the second part within the first part.

14. The locking device of claim 13 wherein the insert portion is integrally connected to the first connecting side of the first part by a breaking line for removing the insert portion from the first connecting side along the breaking line and attaching the insert portion to the second connecting side of the first part.

15. The locking device of claim 14 wherein the second connecting side is provided with a slot for receiving a snap profile extending from the insert portion.

16. A circuit breaker and locking device combination for locking the handle of a circuit breaker in an ON or OFF position, the circuit breaker comprising:

a circuit breaker housing;

an elongated slot in a surface of the circuit breaker housing;

a handle protruding from the elongated slot, the handle pivotally attached within the circuit breaker housing to move from an ON position adjacent a first end of the elongated slot to an OFF position adjacent a second end of the elongated slot;

the locking device comprising:

a first part having a first squeezable side and a second squeezable side;

a first slot-engaging tab extending outwardly from the first squeezable side and a second slot-engaging tab extending outwardly from the second squeezable side; and, a second part sized to fit within the first part;

wherein the first part is within the elongated slot of the circuit breaker housing with the first and second slot-engaging tabs retaining the first part within the elongated slot, and further wherein the first part is removable from the elongated slot by compressing the first and second squeezable sides inwardly to release the first and second slot engaging tabs from the elongated slot, and further wherein the second part fitted within the first part prevents the first and second squeezable sides of the first part from being compressed inwardly.

17. The circuit breaker and locking device of claim 16 wherein the circuit breaker includes a push-to-trip button on the circuit breaker housing adjacent the handle slot and the first part comprises an extension protruding from the first squeezable side of the first part, the extension overlying the push-to-trip button for preventing the push-to-trip button from being pushed.

18. The circuit breaker and locking device of claim 16 wherein the first part of the locking device further comprises a first connecting side and a second connecting side, the first and second connecting sides connecting a top end of the first squeezable side to a top end of the second squeezable side, the first part further comprising a locking device handle portion connecting the first connecting side to the second connecting side.

19. The circuit breaker and locking device of claim 16 wherein the second part comprises a first surface, a second surface, the first surface and the second surface each having a top end and a bottom end, the second part further comprising a top surface connecting the top end of the first surface to the top end of the second surface.

20. The circuit breaker and locking device of claim 19 wherein the second surface of the second part is provided with a rib extending from the top end of the second surface to the bottom end of the second surface, the rib engaging with an interior of the second squeezable side.

21. The circuit breaker and locking device of claim 20 wherein the second squeezable side of the first part and the second surface of the second part are complimentarily curved.

22. The circuit breaker and locking device of claim 9 further comprising projections extending upwardly from the top surface of the second part, the projections for spacing apart padlocks for locking the first part to the second part.

23. The circuit breaker and locking device of claim 16 further comprising an insert portion on the first part, the insert portion comprising flanges engaging with interior ribs within the second part for retaining the second part within the first part.

24. The circuit breaker and locking device of claim 23 wherein the first part of the locking device further comprises a first connecting side and a second connecting side, the first and second connecting sides connecting a top end of the first squeezable side to a top end of the second squeezable side, and wherein the insert portion is integrally connected to the first connecting side of the first part and surrounded by breaking lines for removing the insert portion from the first connecting side, wherein the insert portion, after removing from the first connecting side along the breaking lines, is subsequently attachable to the second connecting side of the first part.

25. The circuit breaker and locking device of claim 24 wherein the second connecting side is provided with a slot for receiving a snap profile extending from the insert portion.

26. The circuit breaker and locking device of claim 24 wherein the insert portion positioned on the first connecting side allows the handle of the circuit breaker to fit alongside the second connecting side of the first part and the insert portion positioned on the second connecting side allows the handle of the circuit breaker to fit alongside the first connecting side of the first part.

27. A locking device for a circuit breaker handle, the locking device comprising:

a first part having a first squeezable side and a second squeezable side, the first and second squeezable sides each having a top end and a bottom end;

the first part further having a first connecting side and a second connecting side, the first and second connecting sides connecting the top end of the first squeezable side to the top end of the second squeezable side;

a first slot-engaging tab extending outwardly from the bottom end of the first squeezable side and a second slot-engaging tab extending outwardly from the bottom end of the second squeezable side; and, an extension protruding from the bottom end of the first squeezable side and adjacent the second connecting side, the extension for overlying a push-to-trip button on a circuit breaker housing;

wherein the first part is for fitting within a slot in a circuit breaker housing with the first and second slot-engaging tabs for retaining the first part within the slot, and further wherein the first part is removable from the slot by compressing the first and second squeezable sides inwardly to release the first and second slot engaging tabs from the slot.

28. The locking device of claim 27 wherein the extension is an elongated flange.

29. The locking device of claim 27 wherein the extension is planar.

30. A locking device for a circuit breaker handle, the locking device comprising:

a first part having a first squeezable side and a second squeezable side, the first and second squeezable sides each having a top end and a bottom end;

the first part further having a first connecting side and a second connecting side, the first and second connecting sides connecting the top end of the first squeezable side to the top end of the second squeezable side;

an insert portion integrally attached to the first connecting side by a breaking line and removable from the first connecting side along the breaking line; and, a first slot-engaging tab extending outwardly from the bottom end of the first squeezable side and a second slot-engaging tab extending outwardly from the bottom end of the second squeezable side;

wherein the first part is for fitting within a slot in a circuit breaker housing with the first and second slot-engaging tabs for retaining the first part within the slot, and further wherein the first part is removable from the slot by compressing the first and second squeezable sides inwardly to release the first and second slot engaging tabs from the slot, and further wherein, with the insert portion attached to the first connecting side, the locking device is usable for locking a circuit breaker handle in an OFF position, and, with the insert portion removed from the first connecting side and subsequently secured to the second connecting side, the locking device is usable for locking a circuit breaker handle in an ON position.

31. The locking device of claim 30 wherein the second connecting side is provided with a slot and the insert portion includes a snap profile, the snap profile received within the slot of the second connecting side when securing the insert portion onto the second connecting side.

32. The locking device of claim 30 wherein the insert portion cannot be reconnected to the first connecting side after removal from the first connecting side.

33. A locking device for a circuit breaker handle, the locking device comprising:

a first part having a first squeezable side and a second squeezable side;

a first slot-engaging tab extending outwardly from the first squeezable side and a second slot-engaging tab extending outwardly from the second squeezable side; and, a second part sized to fit within the first part;

wherein the first part is for fitting within a slot in a circuit breaker housing with the first and second slot-engaging tabs for retaining the first part within the slot, wherein the first part is removable from the slot by compressing the first and second squeezable sides inwardly to release the first and second slot engaging tabs from the slot, and further wherein the second part engaged with the first part prevents the first and second squeezable sides of the first part from being compressed inwardly.

* * * * *